United States Patent [19]

Sarver

[11] 4,177,843

[45] Dec. 11, 1979

[54] WIRE STRAIGHTENER DIE

[76] Inventor: Douglas R. Sarver, 810 Karen Dr., Kingsville, Md. 21087

[21] Appl. No.: 903,713

[22] Filed: May 8, 1978

[51] Int. Cl.[2] ..... B21F 1/02

[52] U.S. Cl. ..... 140/147; 72/79

[58] Field of Search ..... 140/147; 72/79; 76/107 A, 107 S

[56] References Cited

U.S. PATENT DOCUMENTS

| | | | |
|---|---|---|---|
| 2,146,995 | 2/1939 | Simons | 76/107 A |
| 2,394,720 | 2/1946 | Scrantom | 76/107 A |
| 2,720,907 | 10/1955 | Seibel | 140/147 |
| 3,264,855 | 8/1966 | Turbett | 140/147 |

FOREIGN PATENT DOCUMENTS

| | | | |
|---|---|---|---|
| 1957144 | 5/1971 | Fed. Rep. of Germany | 140/147 |

*Primary Examiner*—Lowell A. Larson

*Attorney, Agent, or Firm*—Walter G. Finch

[57] ABSTRACT

The invention is an improved wire straightener die for rotary wire straightener machines and devices used in the production of wire and wire related products from various metals. Each wire straightener die consists of a single unit which is normally used with four other similar dies in a sequence arrangement. The die of this invention is used in any standard rotating wire straightening arbor. Each die in the sequence contains a hardened center core which increases the life of the die. Each die can be installed in the arbor in any one of four different positions, thus giving complete flexibility of use of the die.

7 Claims, 3 Drawing Figures

WIRE STRAIGHTENER DIE

BACKGROUND AND SUMMARY OF THE INVENTION

The invention relates to wire straight and cut machines or mechanisms, and in particular to the wire straightener systems using such wire straight and cut machines or mechanisms used in the production of wire and wire related products, but specifically to the dies used in such wire straightener systems.

A need has existed for a die unit for wire straighteners in wire straight and cut machines or mechanisms that is simple to set up in the wire straightener rotating arbor and, at the same time, has a long life cycle so that frequent die changes are not required.

Existing dies for wire straightener systems in wire straight and cut machines or mechanisms have several disadvantages, some of which are herein described.

Existing wire straightener dies are made of a very soft metal, usually soft iron, so as not to score the wire as it passes through the sequence of dies in the wire straightener. The wear-out time is very short and set up changes are frequent, costly in both time and materials.

The present invention provides a hardened core of carbide or ceramic material in the die which can be given a smooth finish and then lightly polished so as not to score the wire and yet has an extremely long life. Thus, set up changes are infrequent and hence the present invention is much more economical.

Current wire straightener dies are split into two parts, a top half and a bottom half. This "pair" feature consumes time during set up as the multiple parts are handled and care is exercised so that the two halves are assembled to match properly and rest in the proper direction.

The present invention eliminates these problems as each die is in one piece instead of two, and each die is symmetrical about its center so that it may be assembled in either direction, no matching or aligning is required.

Regarding the set up of the die in the rotating arbor of the wire straightener in the wire drawing machine or mechanism, the existing dies (made in a top and a bottom half) have a long entrance bell and a short exit bell, thus the need during set up for matching and aligning the two non-symmetrical halves.

In the present invention the symmetrical design provides a bell at each end of similar size and shape and a straight section between the two bells. With this symmetrical design the die may be set up with either end as the entrance.

As to placing the dies in the die recesses or slots of the rotating arbor of the machine or mechanism, the die of the present invention has a distinct advantage over the existing die.

Both the die of the present invention and the existing die are rectangular in outside configuration. The outside rectangular size of each, for a particular machine for which they are made, is the same, as they both fit into the same die recess or slot.

The existing die can only be placed into the die recess or slot in two positions because of the non-symmetrical passageway through the die; whereas the die of the present invention can be placed into the die recess or slot in four positions. With the symmetrical passageway of the present invention the set up operator may place the die in any position without attention to alignment as is necessary with existing dies. Thus, a distinct set up time advantage for the present invention.

It is to be noted that this invention concerns the straightener die itself and not the positioning or offsetting of any one said die in relation to the other dies in the sequence or series of dies (usually five) that make up the straightener arrangement, nor does it concern the rotary arbor (or drum) or the recesses or slots in said rotary arbor in which any one of said straightener dies is positioned to perform the straightening operation, likewise the invention does not relate to the screws that hold any one said straightener die in position in said recesses or slots in said rotary arbor.

It is, therefore, an object of the invention to provide a wire straightener die that is a one-piece unit.

It is another object of the invention to provide a wire straightener die that is symmetrical about its center to facilitate positioning in a rotary arbor, without the need for special alignment.

It is a further object of the invention to provide a wire straightener die with a hardened passageway to prolong its usefulness.

Further objects and advantages of the invention will become more apparent in light of the following description of the preferred embodiment.

DESCRIPTION OF THE PREFERRED EMBODIMENTS

Figure 2:
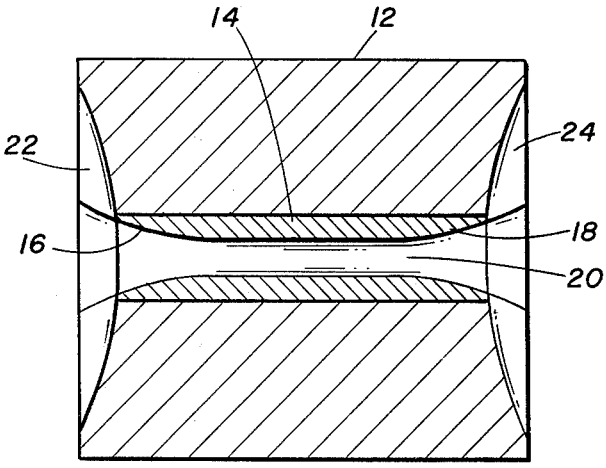
FIG. 2 is a section taken on line 2—2 of FIG. 1.
Figure 1:
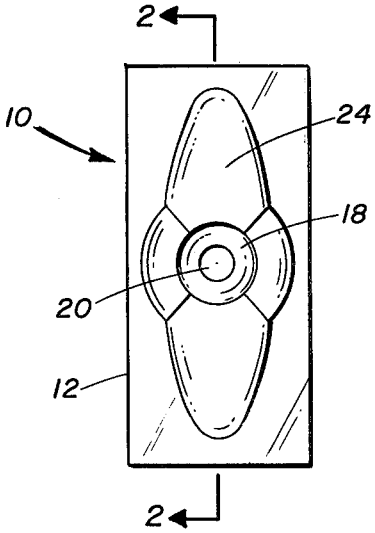
FIG. 1 is an end view of the die.

Referring to the drawings and particularly to FIGS. 1 and 2, an improved wire straightener die is shown at 10 in FIG. 1. In FIGS. 1 and 2 it can be seen that the wire straightener die 10 consists of a die body 12 and a hardened core 14 in which the polished passageway 20 is formed.

The die body 12 is made of metal, usually steel, but may be fabricated of other suitable metals. The die body 12 is rectangular in shape in both directions as can be seen in FIG. 1 and 2. This rectangular shape orients the die for placement in the rotary arbor die recesses or slots 28, 30, 32, 34 and 36 (FIG. 3), which are sized to accept the rectangular die body 12. The ends of the passageway 20 have a bell shaped flare 16 and 18 as shown in FIG. 2. The flares 16 and 18 of the passageway 20 in the hardened core 14 are continued and extend into the die body 12 as can be seen in FIG. 2 and as an end view in FIG. 1. The passageway 20 and the flares 16 and 18 are smooth and highly polished to provide for easy passage of the wire during the straightening process.

Figure 3:
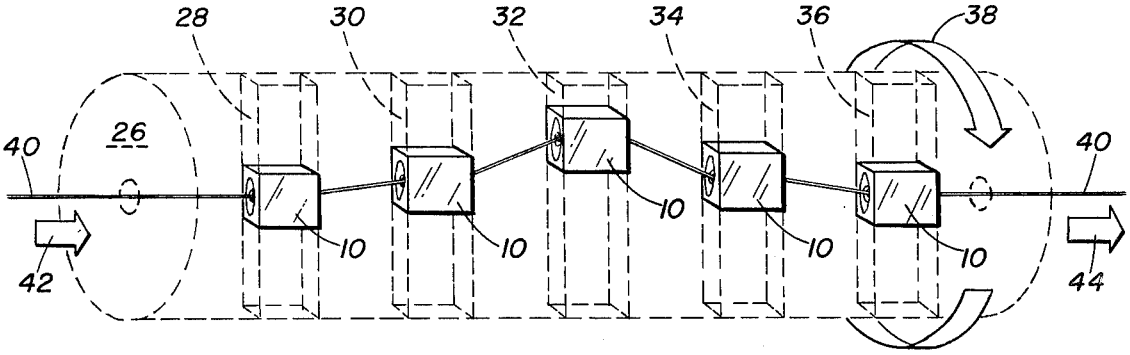
FIG. 3 is a diagrammatic view showing a sequence of dies positioned in offset relation in a rotary arbor of a wire straightener unit.

Referring to FIG. 3, the rotary arbor or drum 26 revolves or rotates in the direction 38 indicated by the encircling arrow at 38.

The wire rod, finished wire 40, or similar elongated material (hereinafter referred to only as "wire"), passes through the rotary arbor 26 from end to end in the direction of the arrow 42 at the entrance and the arrow 44 at the exit.

During the passage of the wire 40 through the rotary arbor 26 the wire 40 passes through the wire straightener dies 10 (usually five) shown one each in the rotary arbor recesses or slots 28, 30, 32, 34, and 36. The wire straightener dies 10 in rotary arbor recesses 28 and 36 serve to maintain the wire in alignment with the entrance to the rotary arbor 26 and with the exit from the rotary arbor 26, respectively.

The three wire straightener dies 10 in rotary recesses 30, 32, and 34 are shown offset from each other and from the previously mentioned wire straightener dies 10 in rotary recesses 28 and 36. This offset provides a cranking type of motion as the rotary arbor 26 rotates in the direction 38 during the wire drawing operation. This cranking motion as a straightening process is common to this type of rotary arbor wire straightener.

The wire straightener dies 10 are maintained in the predetermined positions in the rotary arbor recesses 28, 30, 32, 34, and 36 by screws (not shown) in each end of each of the rotary arbor recesses 28, 30, 32, 34, and 36.

As noted previously, this invention relates to the wire straightener die 10 itself and not the positioning or offsetting of any one of said wire straightener dies 10 in relation to each other, nor to the rotary arbor 26, nor to the rotary arbor recesses 28, 30, 32, 34, and 36, nor does the invention relate to the aforementioned screws.

To facilitate the easy passage of wire 40 into and out of the wire straightener dies 10 in their offset positions in each of the rotary arbor recesses 28, 30, 32, 34, and 36, during the rotating or cranking motion, the upper and lower portions of each end of the die body 12 (above and below the flares 16 and 18) are dished out to provide mating bell shaped flares 22 and 24 (smooth and highly polished). Thus the combination of flares 16 and 18 and the vertical mating flares 22 and 24 respectively provide an easy ingress and egress for the wire 40 into and out of the passageway 20 of each wire straightener die 10 as the aforementioned cranking motion occurs during the rotation of the rotary arbor 26 and the wire drawing operation progresses.

It is to be understood that although wire straight and cut machines and mechanisms have been mentioned herein in connection with wire straightening, this invention pertains to any other wire straightening operation for any purpose where wire straightening dies are required for a rotary wire straightener.

As can be readily understood from the foregoing description of the invention, the present structure can be configured in different modes to provide the ability to serve as a wire straightening die.

Accordingly, modifications and variations to which the invention is susceptible may be practiced without departing from the scope and intent of the appended claims.

I claim:

1. A wire straightener die consisting of a single structure and comprised of:

a metal body; and a hardened core therethrough, said core being centrally located in said metal body, said core having a passageway therethrough, said passageway having a central straight portion with each end thereof continuing into an ever widening bell-shaped flare to the respective end of said hardened core, said hardened core being of a lesser length than said metal body, said metal body beyond the respective ends of said hardened core being flared to communicate said passageway with the exterior of said metal body.

2. The wire straightener die as recited in claim 1, wherein said metal body is steel.

3. The wire straightener die as recited in claim 1, wherein said hardened core is carbide.

4. The wire straightener die as recited in claim 1, wherein said hardened core is a ceramic.

5. The wire straightener die recited in claim 1, wherein said bell-shaped flares at each end of said passageway continues uninterrupted into a continuation of those flares into the metal body beyond the ends of said hardened core as a mating transition in said metal body.

6. The wire straightener die as recited in claim 5, and additionally, said passageway with said flares and said flares in said metal body made smooth and highly polished.

7. The wire straightener die as recited in claim 5, wherein said metal body has a cross section configuration, transverse to said passageway direction, which has a narrower width than the height, and wherein portions of said flares in said metal body extend vertically upward and downward as they continue in transition from said flares of said passageway.

* * * * *